US010960414B2

(12) United States Patent
Pougher et al.

(10) Patent No.: US 10,960,414 B2
(45) Date of Patent: Mar. 30, 2021

(54) CYCLONIC SEPARATOR DEVICE

(71) Applicant: TTI (MACAO COMMERCIAL OFFSHORE) LIMITED, Macau (CN)

(72) Inventors: Simon Pougher, Birmingham (GB); Darren Holmes, Birmingham (GB); Richard Waters, Birmingham (GB); Anna Jaanus, Birmingham (GB)

( * ) Notice: Subject to any disclaimer, the term of this patent is extended or adjusted under 35 U.S.C. 154(b) by 0 days.

(21) Appl. No.: 16/624,662

(22) PCT Filed: Jun. 19, 2017

(86) PCT No.: PCT/GB2017/051788
§ 371 (c)(1),
(2) Date: Dec. 19, 2019

(87) PCT Pub. No.: WO2018/234723
PCT Pub. Date: Dec. 27, 2018

(65) Prior Publication Data

US 2020/0215555 A1 Jul. 9, 2020

(51) Int. Cl.
*B01D 45/12* (2006.01)
*B04C 5/081* (2006.01)
(Continued)

(52) U.S. Cl.
CPC ..... *B04C 5/081* (2013.01); *A47L 5/24* (2013.01); *A47L 9/165* (2013.01); *A47L 9/1633* (2013.01);
(Continued)

(58) Field of Classification Search
CPC ..... B04C 5/081; B04C 5/103; B04C 5/185; B04C 5/26; B04C 5/28; A47L 9/242;
(Continued)

(56) References Cited

U.S. PATENT DOCUMENTS 6,141,826 A * 11/2000 Conrad ..... A47L 9/165 15/347
6,461,508 B1 * 10/2002 Thomson ..... B01D 45/08 210/512.1

(Continued)

FOREIGN PATENT DOCUMENTS

| | | | |
|---|---|---|---|
| EP | 2581018 | A1 | 4/2013 |
| GB | 2481608 | A | 1/2012 |
| WO | 2009073888 | A1 | 6/2009 |

OTHER PUBLICATIONS

International Search Report and Written Opinion for Application No. PCT/GB2017/051788 dated Apr. 26, 2018 (12 pages).

*Primary Examiner* — Dung H Bui
(74) *Attorney, Agent, or Firm* — Michael Best & Friedrich LLP

(57) ABSTRACT

A cyclonic separator device for removing dust or debris from dirt-laden air includes a first separating chamber, a first dirt collection chamber in communication with the first separating chamber, a shroud, a second separating chamber positioned generally within the shroud, and a second dirt collection chamber in communication with the second separating chamber. The second separating chamber includes a generally frusto-conical portion that has an end part in communication with the second dirt collection chamber through which fine dust or debris exits therethrough into the second dirt collection chamber. A first portion of the second dirt collection chamber surrounds an outer surface of the end part of the generally frusto-conical portion to define a space S1 therebetween and said first portion of the second dirt collection chamber extends into a space S2 defined by the inner surface of the generally cylindrical portion of the shroud having said openings therein.

24 Claims, 10 Drawing Sheets

(51) Int. Cl.

| | |
|---|---|
| ***A47L 5/24*** | (2006.01) |
| ***A47L 9/16*** | (2006.01) |
| ***A47L 9/24*** | (2006.01) |
| ***B04C 5/103*** | (2006.01) |
| ***B04C 5/185*** | (2006.01) |
| ***B04C 5/26*** | (2006.01) |

(52) U.S. Cl.
CPC ..... *A47L 9/1658* (2013.01); *A47L 9/1683* (2013.01); *A47L 9/242* (2013.01); *B04C 5/103* (2013.01); *B04C 5/185* (2013.01); *B04C 5/26* (2013.01)

(58) Field of Classification Search
CPC ..... A47L 9/165; A47L 5/24; A47L 9/1683; A47L 9/1658; A47L 9/1633; A47L 9/1625; A47L 9/1641
See application file for complete search history.

(56) References Cited

U.S. PATENT DOCUMENTS 7,065,826 B1 * 6/2006 Arnold ..... A47L 9/1608 15/353
7,419,522 B2 * 9/2008 Arnold ..... A47L 9/1633 55/345
8,679,211 B1 * 3/2014 Makarov ..... A47L 9/1641 55/343
2008/0271284 A1 * 11/2008 Wood ..... A47L 9/106 15/353
2008/0289139 A1 * 11/2008 Makarov ..... A47L 9/1666 15/350
2009/0007369 A1 * 1/2009 Gomiciaga-Pereda ..... B04C 5/10 15/347
2009/0100633 A1 * 4/2009 Bates ..... A47L 9/1683 15/347
2009/0100634 A1 * 4/2009 Bates ..... A47L 9/106 15/347
2009/0100810 A1 * 4/2009 Smith ..... A47L 9/1641 55/343
2009/0313958 A1 * 12/2009 Gomiciaga-Pereda ..... B04C 5/26 55/317
2012/0000029 A1 * 1/2012 Nicolaou ..... A47L 9/20 15/300.1
2012/0047682 A1 * 3/2012 Makarov ..... A47L 9/1683 15/347
2012/0167336 A1 * 7/2012 Tran ..... A47L 9/122 15/347
2012/0210537 A1 * 8/2012 Makarov ..... A47L 9/1641 15/353
2012/0272474 A1 * 11/2012 Follows ..... A47L 9/1641 15/347
2012/0284957 A1 * 11/2012 Follows ..... B04C 5/28 15/353
2013/0160233 A1 6/2013 Peace et al.
2013/0291334 A1 * 11/2013 Peng ..... A47L 9/165 15/353
2013/0333156 A1 * 12/2013 McLuckie ..... A47L 9/16 15/353
2014/0020205 A1 * 1/2014 Makarov ..... A47L 5/28 15/353
2014/0137364 A1 * 5/2014 Stickney ..... A47L 9/1683 15/347
2014/0196605 A1 * 7/2014 Morgan ..... A47L 9/1683 95/271
2014/0223871 A1 * 8/2014 Makarov ..... B04C 5/26 55/343
2017/0156559 A1 * 6/2017 Krebs ..... A47L 9/24
2017/0296017 A1 * 10/2017 Hyun ..... B04C 7/00
2018/0125316 A1 * 5/2018 Woo ..... A47L 9/108
2018/0271343 A1 * 9/2018 Hyun ..... A47L 9/1683
2020/0054183 A1 * 2/2020 Buttery ..... H01M 2/1022

* cited by examiner

CYCLONIC SEPARATOR DEVICE

CROSS-REFERENCE TO RELATED APPLICATIONS

The present application is a U.S. National Phase application of PCT/GB2017/051788 filed Jun. 19, 2017, the contents of which are herein incorporated by reference.

DESCRIPTION OF INVENTION

This invention relates to a cyclonic separation device and particularly, but not exclusively, to a surface cleaning apparatus including such a device.

In more detail, the invention relates to improving the performance of a cyclonic separating device by optimising certain characteristics and dimensions of the various component parts of the device, for example, in relation to optimising the performance of a cyclonic separating device which is horizontal or otherwise inclined in normal use.

According to an aspect of the invention we provide a cyclonic separator device for removing dust or debris from dirt-laden air, the device including:

a first separating chamber for separating relatively coarse dust or debris from the dirt-laden air;

an inlet through which dirt-laden air is drawn into the first separating chamber;

a first dirt collection chamber in communication with the first separating chamber;

a shroud;

a second separating chamber positioned generally within the shroud for separating relatively fine dust or debris from the dirt-laden air cleaned by the first separating chamber, a second dirt collection chamber in communication with the second separating chamber;

an outlet through which cleaner air exits the second separating chamber;

wherein the first separating chamber includes a generally cylindrical portion with a central axis and wherein the inlet is configured to direct the incoming dirt-laden air into said generally cylindrical portion such that it travels circumferentially around an inner surface of the first separating chamber, wherein the shroud is positioned generally centrally of the generally cylindrical portion of the first separating chamber and the shroud has a generally cylindrical portion having a height D with openings therein for the passage of air therethrough towards the second separating chamber, wherein the second separating chamber includes:

an inlet through which cleaned dirt-laden air exiting the first separating chamber is drawn into the second separating chamber; and optionally or preferably the second separating chamber includes:

a generally frusto-conical portion with a central axis and the generally frusto-conical portion has an end part in communication with the second dirt collection chamber through which fine dust or debris exits therethrough into the second dirt collection chamber, and wherein the inlet of the second dirt collection chamber is configured to direct the incoming said cleaned dirt-laden air such that it travels circumferentially around an inner surface of the generally frusto-conical portion, and wherein a first portion of the second dirt collection chamber surrounds an outer surface of the end part of the generally frusto-conical portion to define a space S1 therebetween and said first portion of the second dirt collection chamber extends into a space S2 defined by the inner surface of the generally cylindrical portion of the shroud having said openings therein.

The first portion of the second dirt collection chamber may extend a height H into said space S2, and the ratio (H:D) between height H and the height D of the generally cylindrical portion of the shroud may be defined by the range:

$1:1.2 \leq H:D \leq 1:4.5$.

(H:D) may be defined by the range:

$1:1.5 \leq H:D \leq 1:2.7$ (H:D) may be defined by the range:

$1:1.8 \leq H:D \leq 1:2.0$.

(H:D) may be or may be about 1:1.9.

The second dirt collection chamber includes a second portion connected to the first portion, wherein the first portion has a greater cross-sectional area than the second portion.

According to a further aspect of the invention we provide a cyclonic separator device for removing dust or debris from dirt-laden air, the device including:

a first separating chamber for separating relatively coarse dust or debris from the dirt-laden air;

an inlet through which dirt-laden air is drawn into the first separating chamber;

a first dirt collection chamber in communication with the first separating chamber;

a shroud;

a second separating chamber positioned generally within the shroud for separating relatively fine dust or debris from the dirt-laden air cleaned by the first separating chamber, a second dirt collection chamber in communication with the second separating chamber;

an outlet through which cleaner air exits the second separating chamber;

wherein the first separating chamber includes a generally cylindrical portion with a central axis and wherein the inlet is configured to direct the incoming dirt-laden air into said generally cylindrical portion such that it travels circumferentially around an inner surface of the first separating chamber, wherein the shroud is positioned generally centrally of the generally cylindrical portion of the first separating chamber and the shroud has a generally cylindrical portion with openings therein for the passage of air therethrough towards the second separating chamber, wherein the second dirt separating chamber includes:

an inlet through which cleaned dirt-laden air exiting the first separating chamber is drawn into the second separating chamber; and the second dirt collection chamber optionally or preferably includes:

a generally frusto-conical portion with a central axis and the frusto-conical portion has an end-part in communication with the second dirt collection chamber through which fine dust or debris exits therethrough into the second dirt collection chamber, and wherein the inlet of the second dirt collection chamber is configured to direct the incoming said cleaned dirt-laden air such that it travels circumferentially around an inner surface of the generally frusto-conical portion, and wherein the second dirt collection chamber optionally or preferably includes:

a first portion which surrounds an outer surface of the end part of the frusto-conical portion to define a space S1 therebetween; and a second portion connected to the first portion, wherein the first portion has a greater cross-sectional area than the second portion.

Said first portion of the second dirt collection chamber may extend into a space S2 defined by the inner surface of the generally cylindrical portion of the shroud having said openings defined therein.

The first portion of the second dirt collection chamber may have an end which is in sealed engagement or substantially sealed engagement with the end part of the frusto-conical portion having said openings.

The first portion of the second dirt collection chamber may have a height H about its central axis, and the generally frusto-conical portion of the second separating chamber may have a height H2 along its central axis, wherein the ratio (H:H2) between them may be defined by the range:

$1:1.2 \leq H:H2 \leq 1:7$.

The ratio (H:H2) may be defined by the range:

$1:1.3 \leq H:H2 \leq 1:5.3$.

The ratio (H:H2) may be defined by the range $1:1.4 \leq H:H2 \leq 1:4.7$.

(H:H2) may be or may be about 1:4.5.

The first portion of the second dirt collecting chamber may be generally cylindrical and may have a diameter D1 across its inner surface; and the second portion of the second dirt collecting chamber may be generally cylindrical and may have a diameter D2 across its inner surface, wherein the ratio (D1:D2) is defined by the range:

$1.05:1 \leq D1:D2 \leq 1.60:1$.

(D1:D2) may be defined by the range:

$1.07:1 \leq D1:D2 \leq 1.20:1$.

(D1:D2) may be defined by the range:

$1.07:1 \leq D1:D2 \leq 1.15:1$.

(D1:D2) may be defined by the range:

$1.07:1 \leq D1:D2 \leq 1.13:1$.

(D1:D2) may be defined by the range:

$1.07:1 \leq D1:D2 \leq 1.1:1$.

(D1:D2) may be or may be about 1:09:1.

A third portion which is frusto-conical may connect the first portion to the second portion.

The second dirt collection chamber may include a baffle positioned generally centrally thereof and which extends from a lower end of the second portion of the second dirt collection chamber upwardly towards the first portion of the second dirt collection chamber.

The baffle may terminate in a conical portion.

The conical portion may extend into the end part of the frusto-conical portion of the second separating chamber.

An outer diameter U of the first portion of the second dirt collection chamber and an inner diameter V of the cylindrical portion of the shroud may satisfy a ratio (U:V) defined by the range:

$1:1.1 \leq U:V \leq 1:1.5$.

(U:V) may be defined by the range:

$1:1.2 \leq U:V \leq 1:1.4$.

(U:V) may be or may be about 1:1.3.

According to a further aspect of the invention we provide a cyclonic separator for removing dust or debris from dirt-laden air, the device including:

a first separating chamber for separating relatively coarse dust or debris from the dirt-laden air;

an inlet through which dirt-laden air is drawn into the first separating chamber;

a first dirt collection chamber in communication with the first separating chamber;

a shroud;

an outlet through which cleaner air exits the first separating chamber;

wherein the first separating chamber includes a generally cylindrical portion with a central axis and wherein the inlet is configured to direct the incoming dirt-laden air into said generally cylindrical portion such that it travels circumferentially around an inner surface of the first separating chamber, wherein the shroud is positioned generally centrally of the generally cylindrical portion of the first separating chamber and the shroud has a generally cylindrical portion having a height D with openings therein for the passage of air, wherein the generally cylindrical portion of the shroud has an outer diameter K and the first separating chamber has an inner diameter P and wherein the ratio (K:P) lies in the range:

$1:1.2 \leq K:P \leq 1:1.5$.

Any preceding aspects of the invention may include one or more of the following.

(K:P) may lie in the range:

$1:1.3 \leq K:P \leq 1:1.5$.

(K:P) ma lie in the range:

$1:1.35 \leq K:P \leq 1:1.45$.

(K:P) may be or may be about 1:1.38.

The distance Q between an inner surface of the generally cylindrical portion of the first separation chamber and the outer surface of the generally cylindrical portion of the shroud may be in the range of 13-20 mm, or 14 to 19 mm, or 15-18 mm, or 15-17 mm, or is 16 mm.

A distance L between an outer surface of the first portion and the inner surface of the generally cylindrical portion of the shroud may be in the range 6-11 mm, 7-10 mm, 8-10 mm or is 9 mm.

The outer diameter of the generally cylindrical portion of the shroud may be in the range 79-83 mm, 81-83 mm or is 82 mm.

The generally cylindrical portion of the shroud may have an outer diameter K in the range of 87-91 mm, optionally or preferably in the range of 89-91 mm, and optionally or preferably the outer diameter K is or is about 90 mm.

The generally cylindrical portion of the shroud may have an outer surface which is spaced a distance J from an inner surface of the generally cylindrical portion of the first separating chamber in the range of 15-17 mm, optionally or preferably in the range of 15.5-16.5 mm, optionally or preferably in the range of 15.75-16.25 mm, optionally or preferably in the range of 15.9-16.1 mm, and optionally or preferably the distance J is 16 mm or about 16 mm.

The shroud may include a peripheral skirt wherein the skirt has an outer diameter which is equal to an outer diameter of the generally cylindrical portion of the shroud.

An inner diameter P of the generally cylindrical portion of the first separating chamber may be in the range of 121-127 mm, optionally or preferably in the range of 122-126 mm, optionally or preferably in the range of 123-125 mm, optionally or preferably in the range of 123.5-124.5 mm and optionally or preferably the inner diameter P is or is about 124.0 mm.

The shroud may include a peripheral skirt which extends towards an end of the first dirt collection chamber, wherein a free peripheral edge of the skirt is spaced a distance M from an inner surface of the end of the first dirt collection chamber at a distance in the range of 40-45 mm, optionally or preferably in the range of 41-44 mm, optionally or preferably in the range of 42-43 mm, optionally or preferably in the range of 41.5-42.5 mm, and optionally or preferably the distance M is or is about 42.0 mm.

Sn end of the generally cylindrical portion of the shroud may face an inner surface of an end of the first dirt collection chamber, wherein said end of the generally cylindrical portion of the shroud is spaced from the inner surface of an end of the first dirt collection chamber a distance N in the range of 55-61 mm, optionally or preferably in the range of 56-60 mm, optionally or preferably in the range of 57-58 mm, optionally or preferably in the range of 57-38 mm, optionally or preferably in the range of 57.5-58.5 mm, and optionally or preferably the distance N is or is about 58.0 mm.

Said generally cylindrical portion of the shroud may have an outer diameter K in the range of 87-91 mm, optionally or preferably in the range of 89-91 mm, and optionally or preferably the outer diameter K is or is about 90.0 mm.

Said generally cylindrical portion of the shroud may have an outer surface which is spaced from an inner surface of the generally cylindrical portion of the first separating chamber a distance J in the range of 15-17 mm, optionally or preferably in the range of 15.5-16.5 mm, optionally or preferably in the range of 15.75-16.25 mm, optionally or preferably in the range of 15.9-16.1 mm, and optionally or preferably the distance J is or is about 16 mm.

An inner diameter P of the generally cylindrical portion of the first separating chamber may be in the range of 121-127 mm, optionally or preferably in the range of 122-126 mm, optionally or preferably in the range of 123-125 mm, optionally or preferably in the range of 123.5-124.5 mm and optionally or preferably the inner diameter P is or is about 124 mm.

The shroud may include a peripheral skirt which extends towards an end of the first dirt collection chamber, wherein a free peripheral edge of the skirt is spaced a distance M from an inner surface of the end of the first dirt collection chamber at a distance M in the range of 40-45 mm, optionally or preferably in the range of 41-44 mm, optionally or preferably in the range of 42-43 mm, optionally or preferably in the range of 41.5-42.5 mm, and optionally or preferably the distance M is or is about 42.0 mm.

An end of the generally cylindrical portion of the shroud may face an inner surface of an end of the first dirt collection chamber, wherein said end of the generally cylindrical portion of the shroud is spaced from the inner surface of the end of the first dirt collection chamber a distance N which is optionally or preferably in the range of 55-61 mm, optionally or preferably in the range of 56-60 mm, optionally or preferably in the range of 51-58 mm, optionally or preferably in the range of 57.5-58.5 mm, optionally or preferably the distance N is or is about 58 mm.

The shroud may have a central axis which is substantially coaxial or coaxial with the central axis of the generally cylindrical portion of the first separating chamber.

The shroud may be connected to one end of the first separating chamber and is free at an opposite end.

According to a further aspect of the invention we provide a surface cleaning apparatus including a separator device according to any preceding aspect.

The surface cleaning apparatus may include:

a surface cleaning tool;

a housing supporting a suction source; and an elongate member connecting the surface cleaning tool to the housing, said elongate member including a passage for carrying dirt-laden air from the floor head to the dirt collection chamber.

The elongate member may be disconnectable from the surface cleaning tool.

The elongate member may be disconnectable from the housing.

The apparatus may be an handheld surface cleaning apparatus.

An axis of the cyclonic separation device may extend transversely to an elongate axis of the elongate member.

An axis of the cyclonic separation device may extend perpendicularly to an elongate axis of the elongate member.

The source of suction may be a fan rotatable by a motor.

In normal use, the first and second cyclonic separating chambers may be generally horizontal or the elongate axes thereof are generally horizontal.

Embodiments of the invention will be set out below by way of example only with reference to the accompanying figures, of which:

Figure 1:
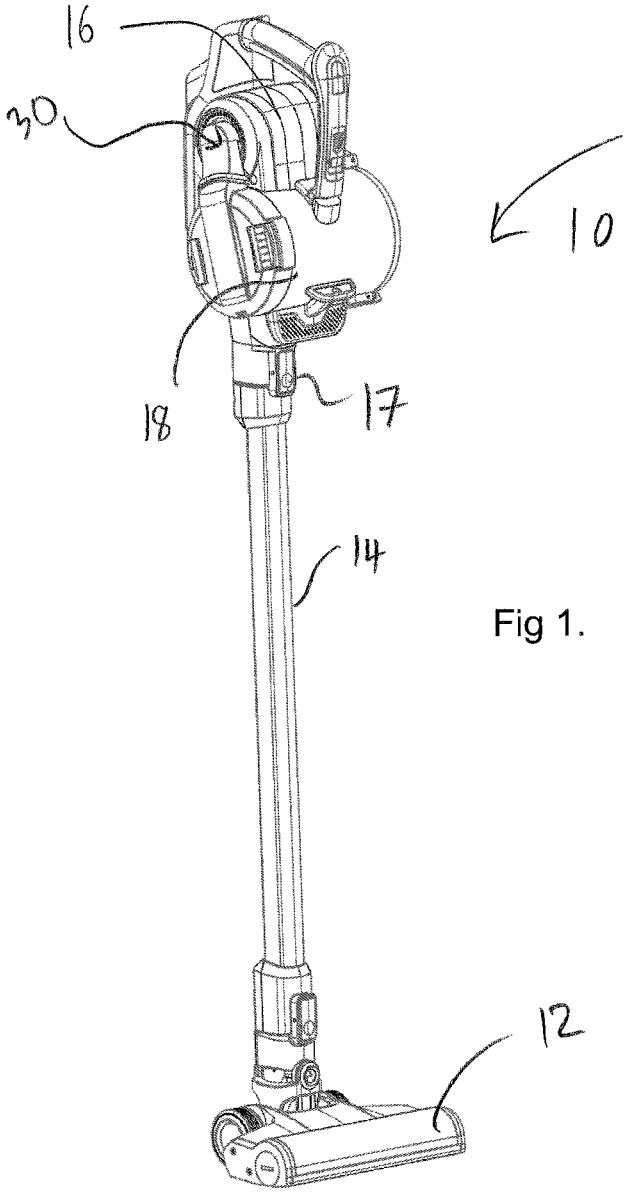
FIG. 1 is a perspective view of a surface cleaning apparatus.
Figure 2:
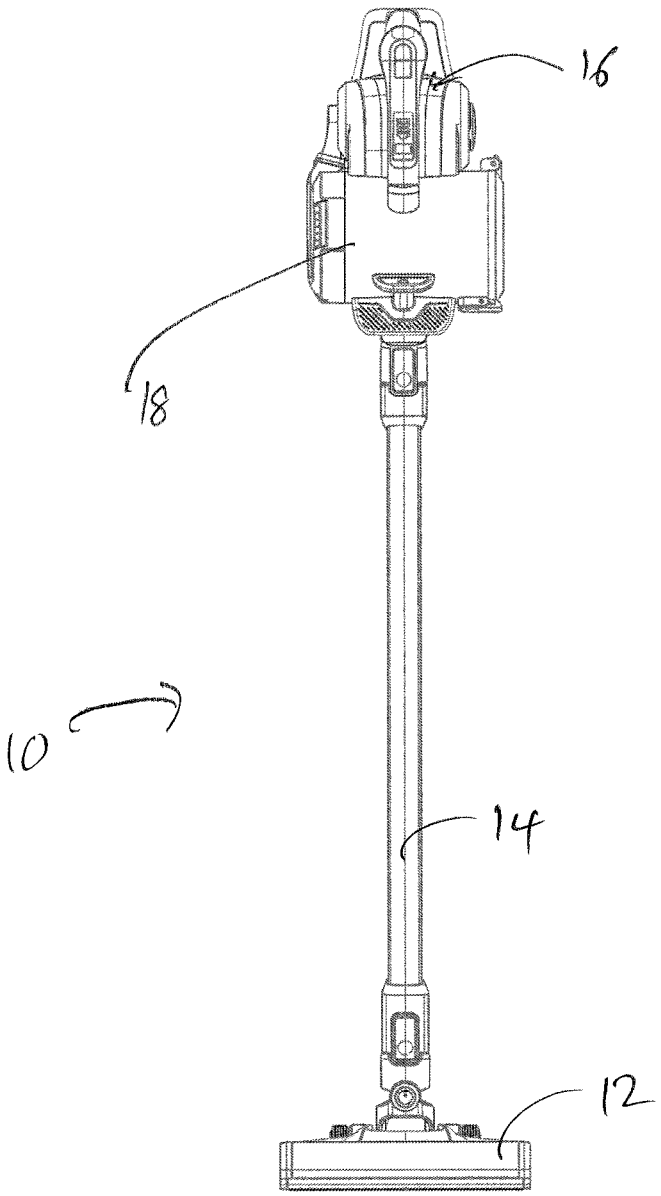
FIG. 2 is a front view of the apparatus of FIG. 1.
Figure 3:
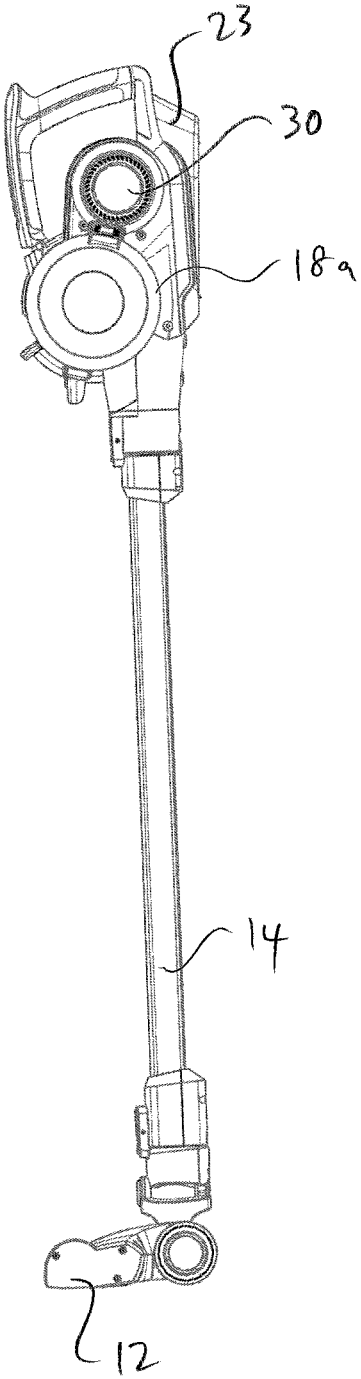
FIG. 3 is a side view of the apparatus FIG. 1.
Figure 4:
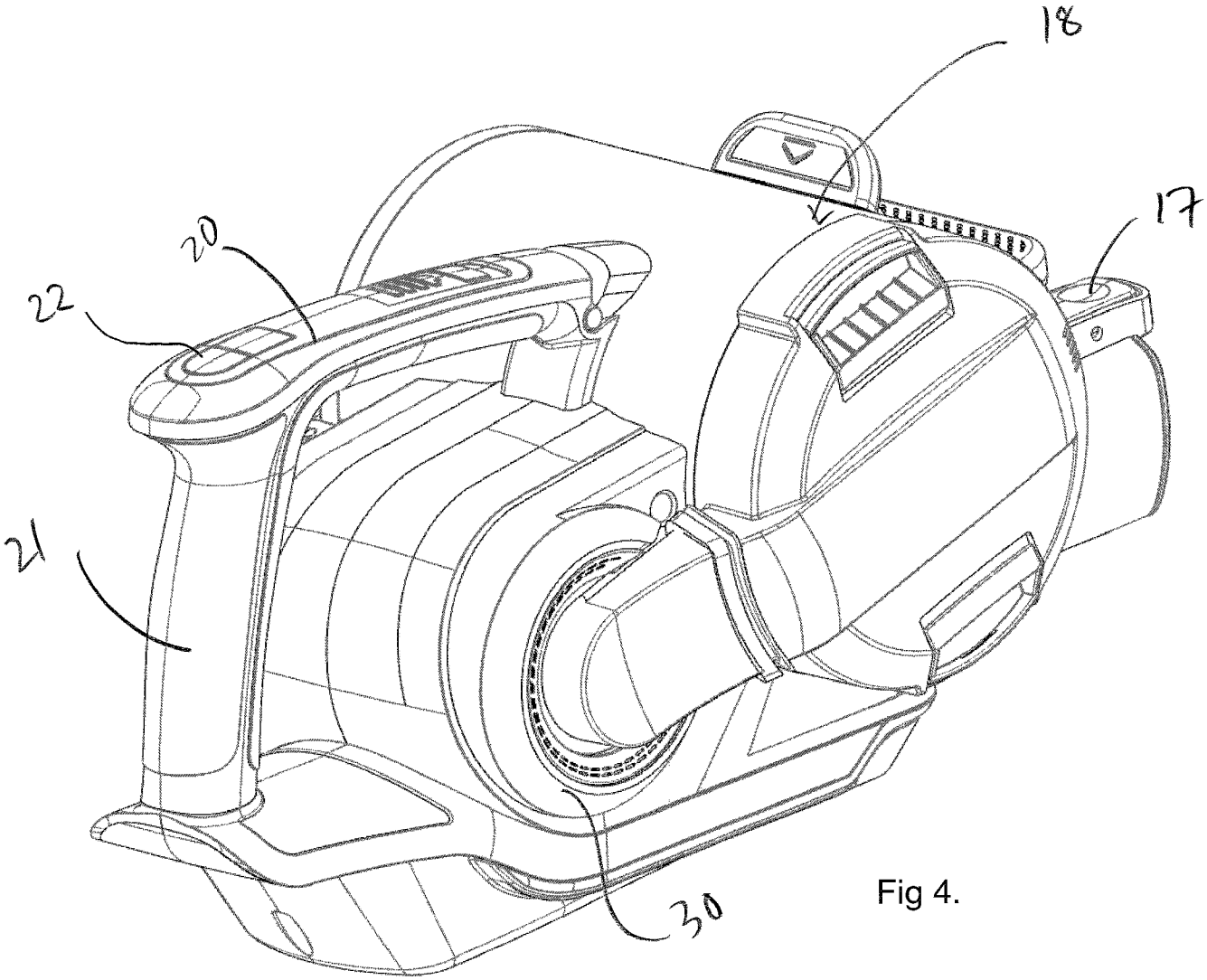
FIG. 4 is a perspective view of a housing of the apparatus of FIG. 1, which housing is operable as a handheld surface cleaning apparatus.
Figure 5:
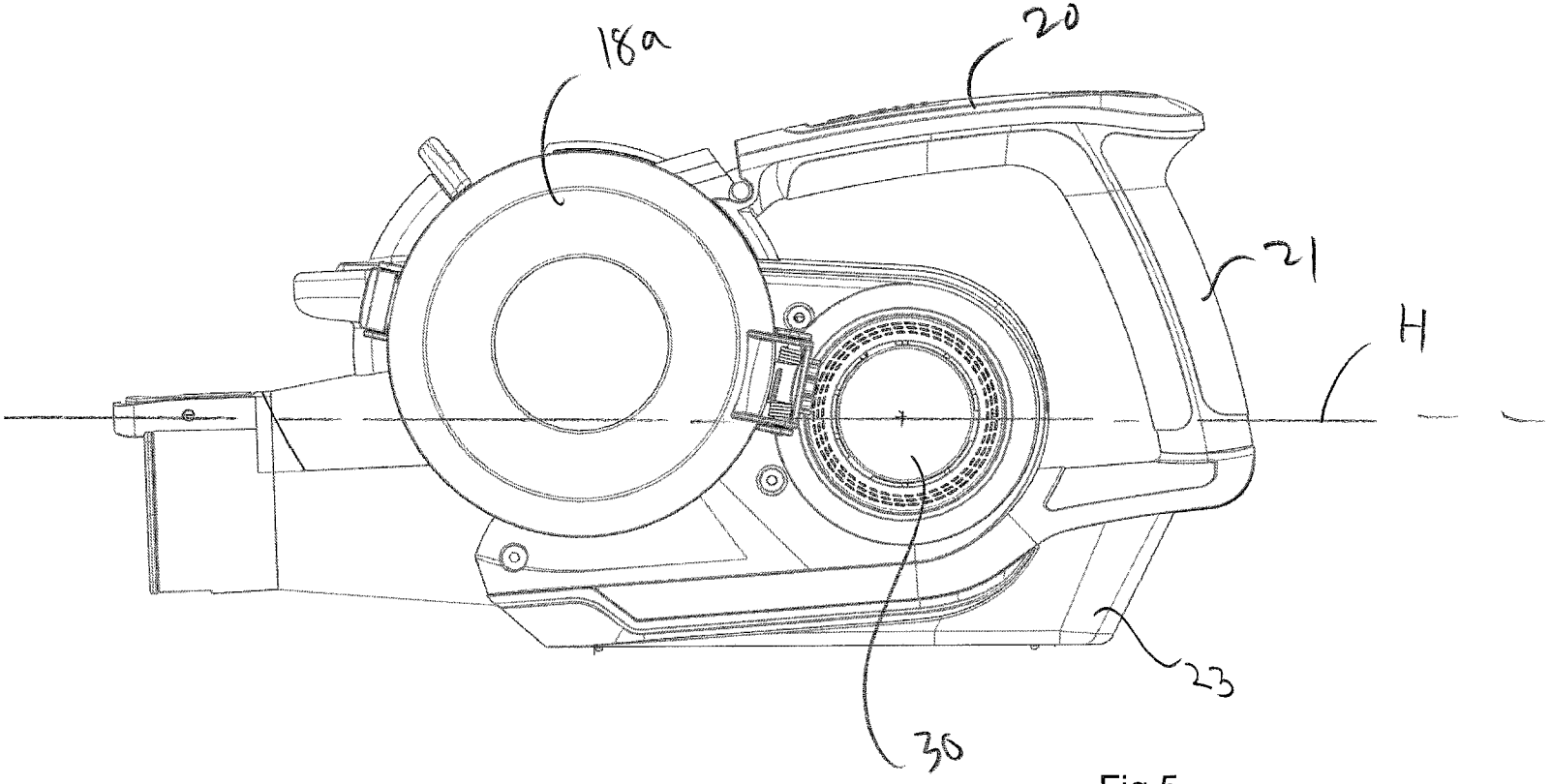
FIG. 5 is a side view of the housing of FIG. 5.
Figure 6:
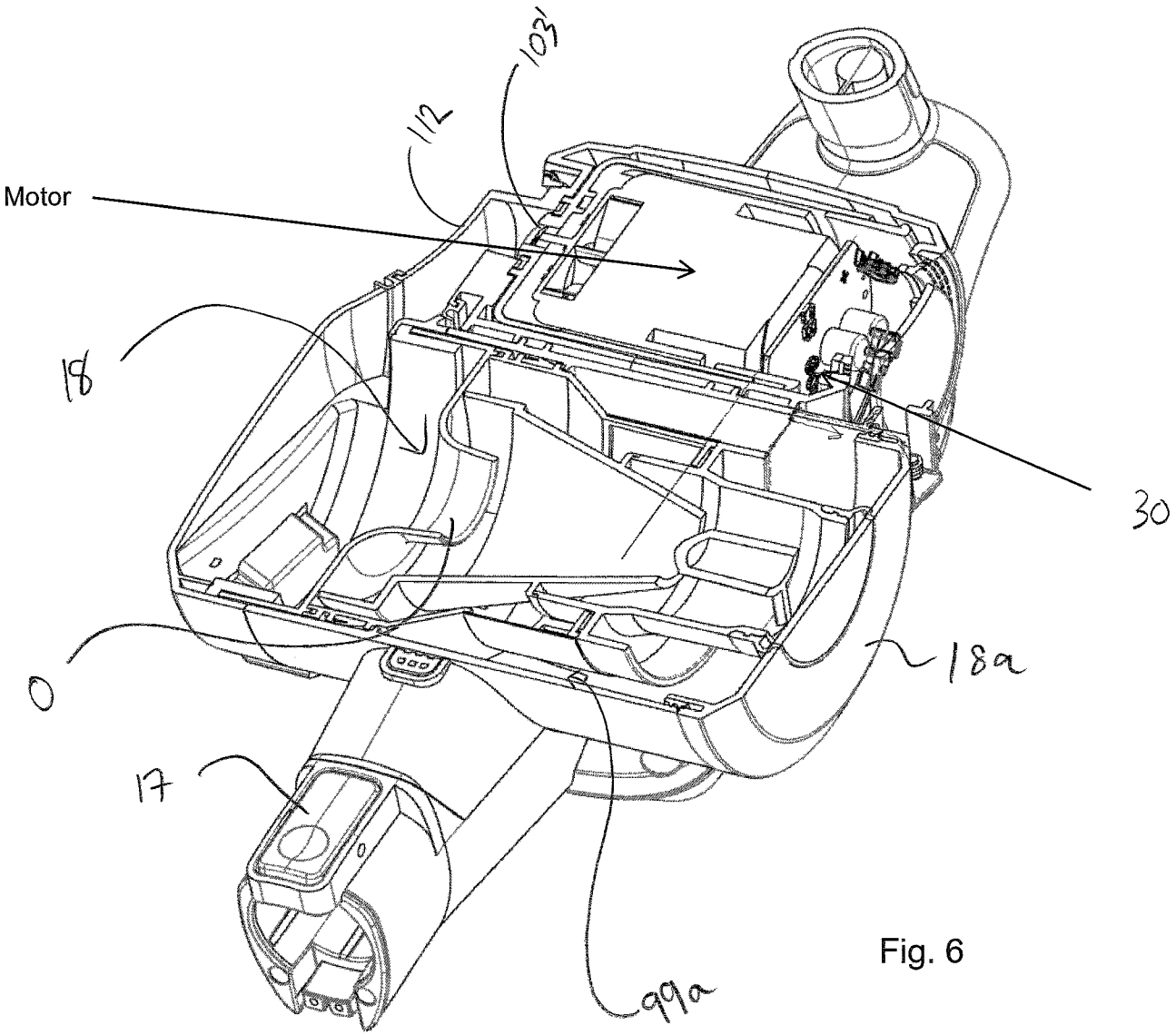
FIG. 6 is a perspective cross-sectional view of the housing of FIG. 5.
Figure 7:
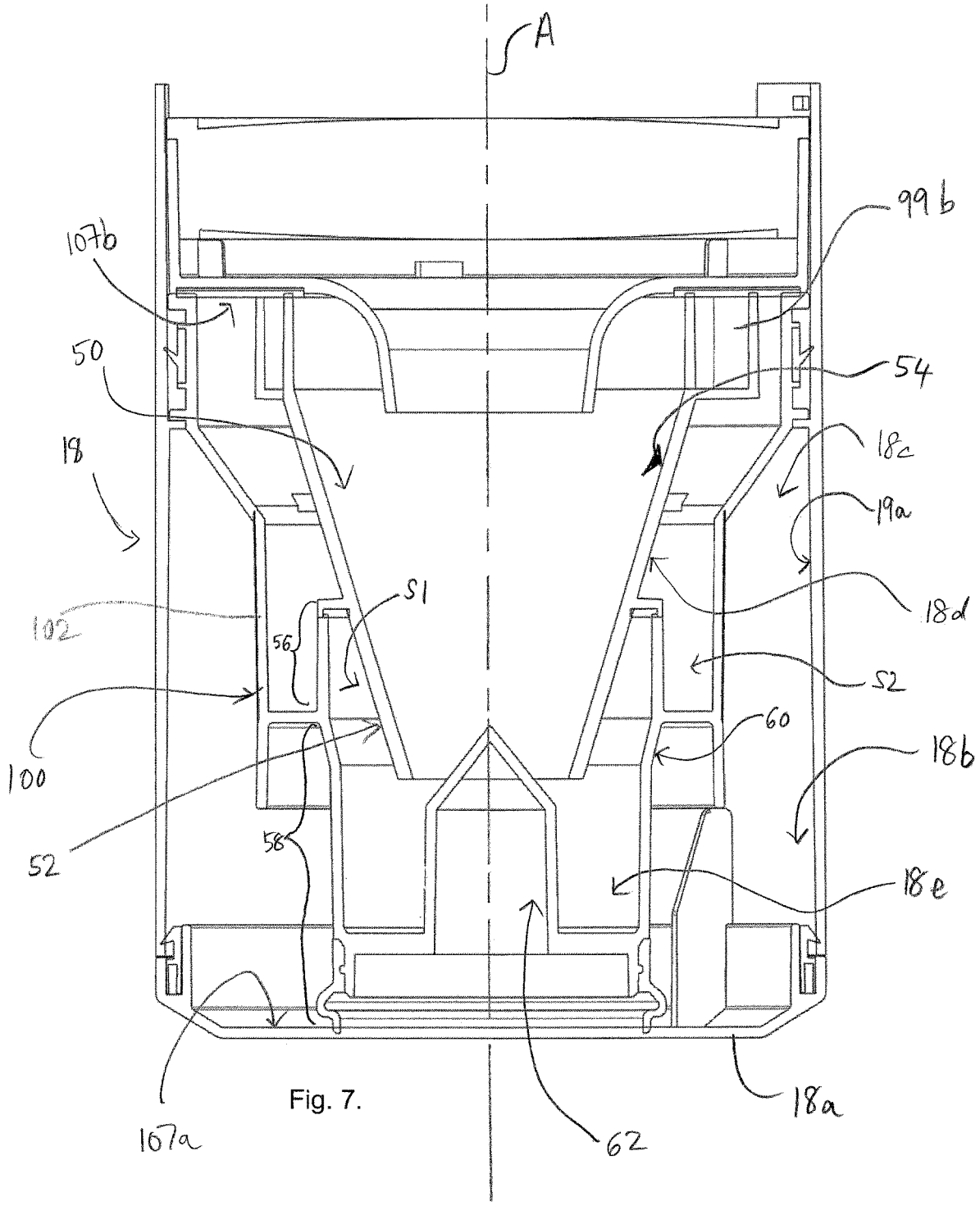
FIGS. 7 to 10 are cross-sectional views of a cyclonic separator device of the apparatus of FIG. 1.
Figure 8:
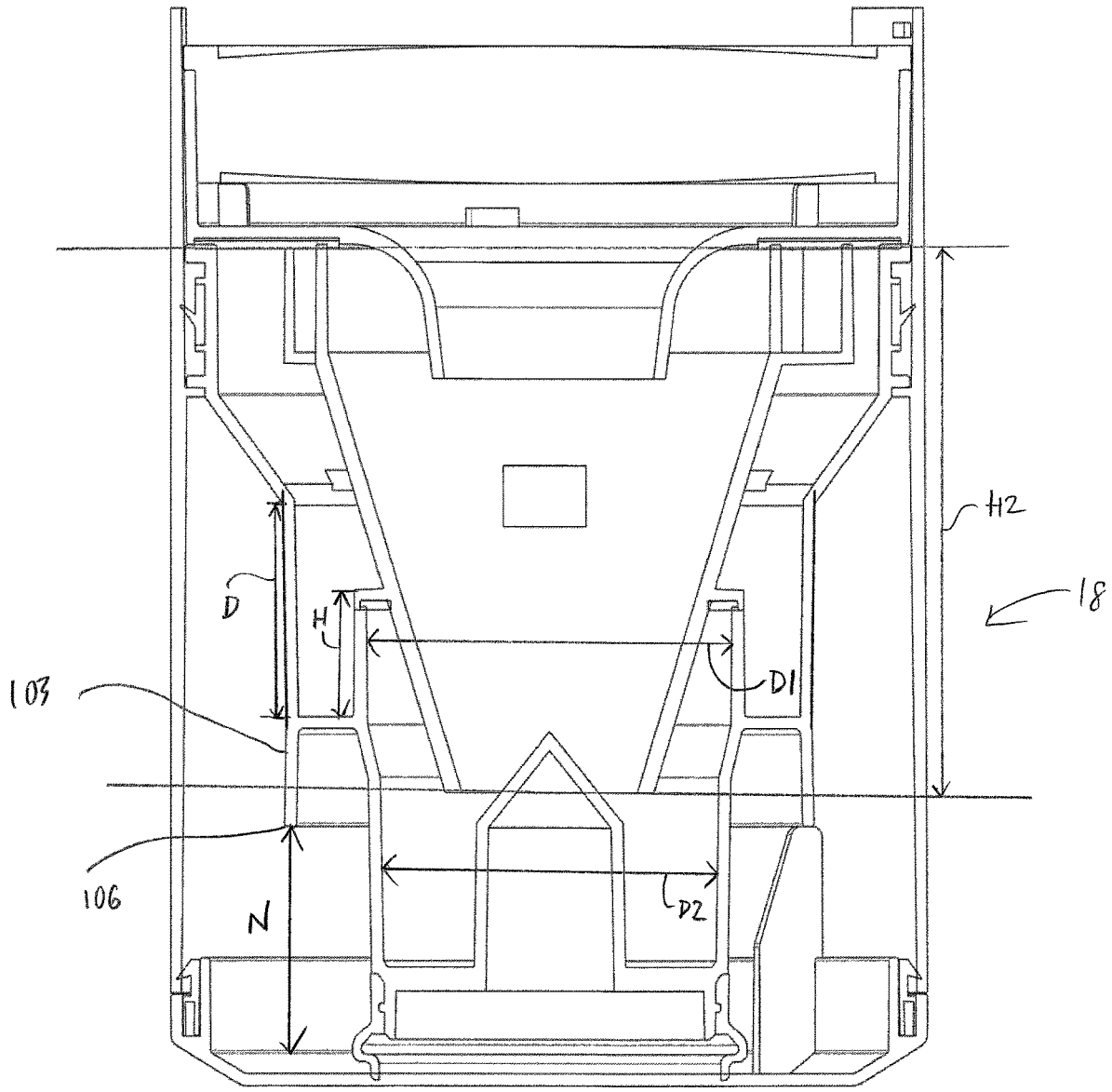
Figure 9:
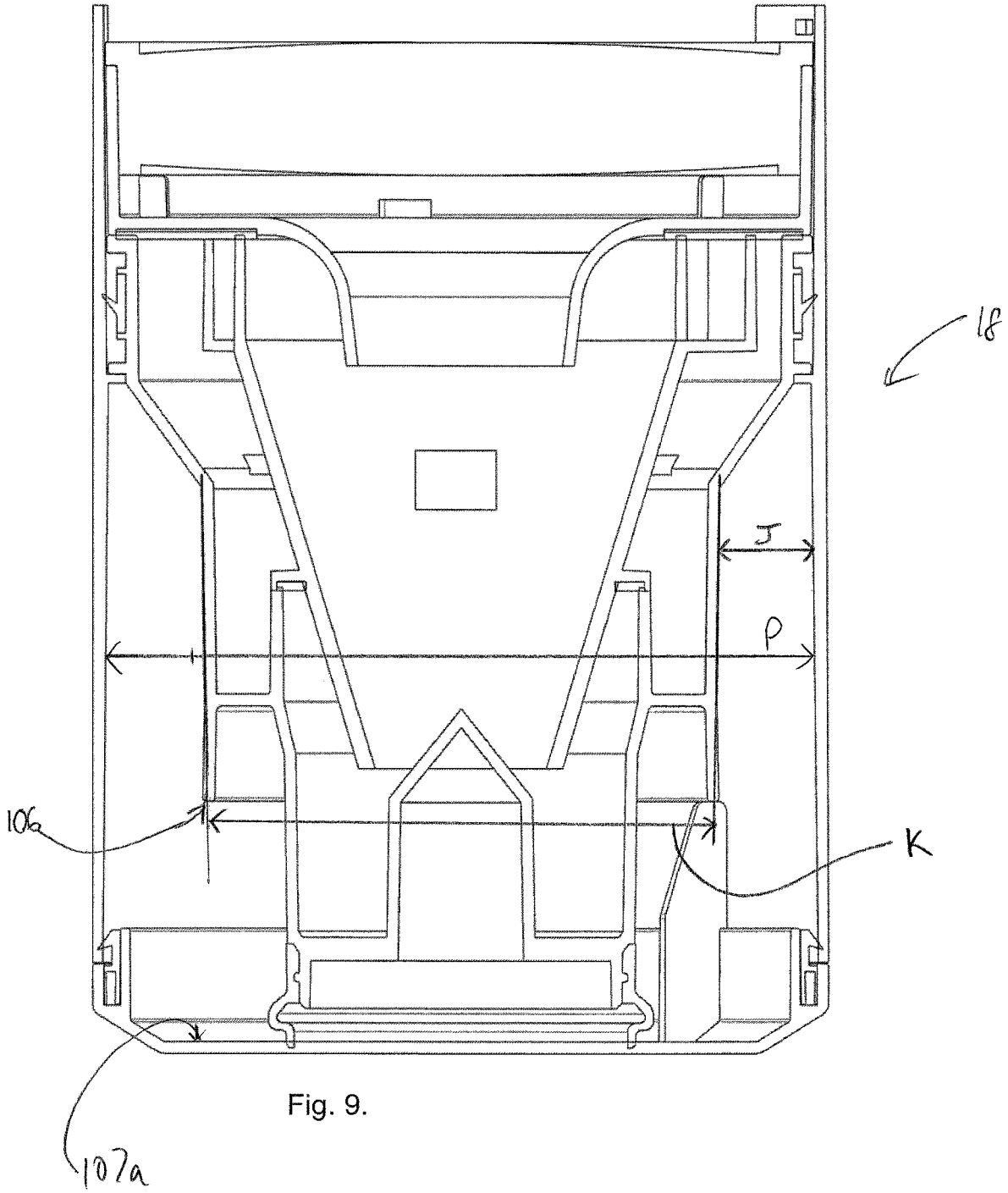
Figure 10:
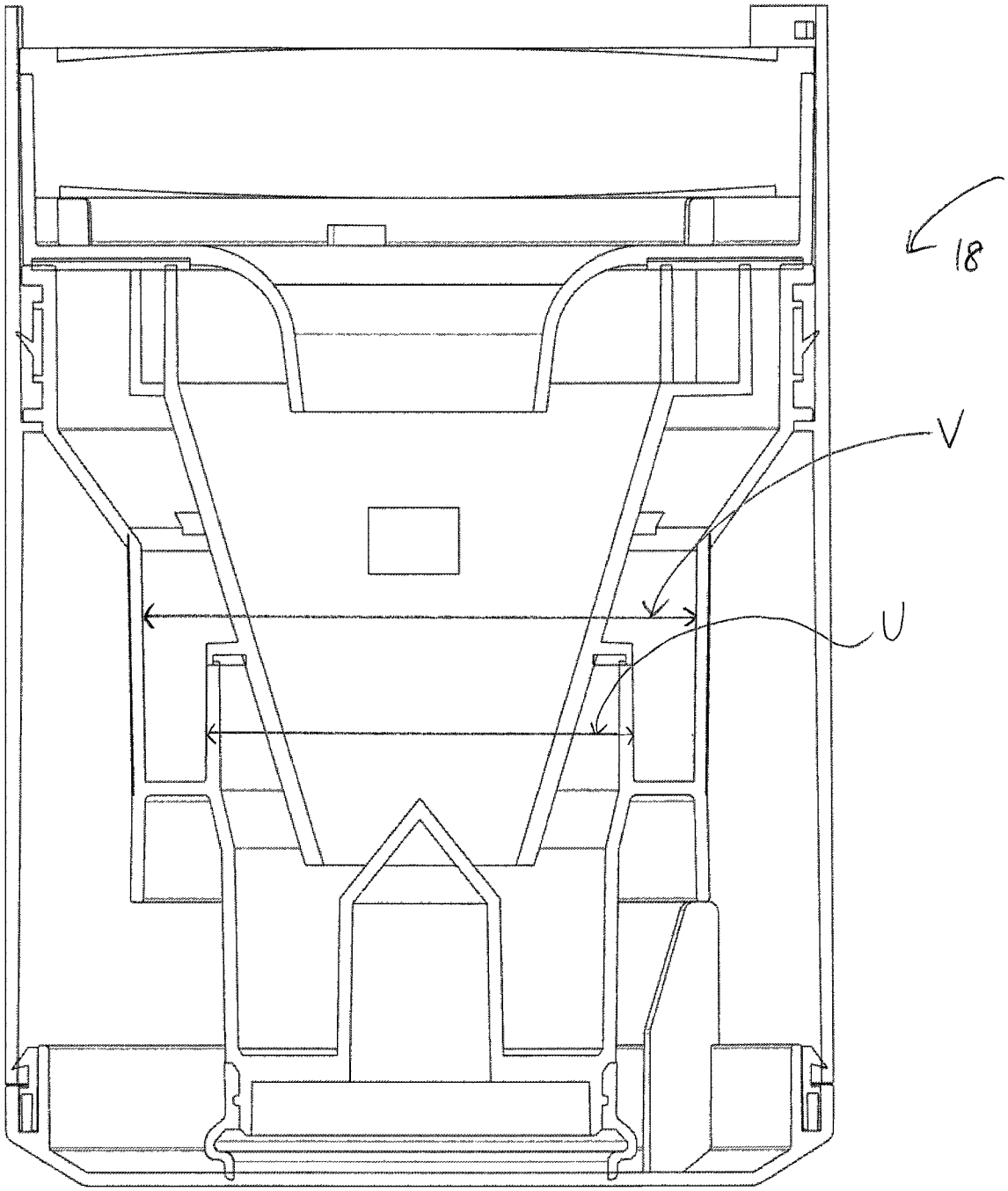

Referring to the figures, these show a surface cleaning apparatus 10 in accordance with the present invention. The apparatus 10 includes a surface cleaning tool 12 (a floor head in this example), a housing 16 and an elongate member 14 connecting the surface cleaning tool 12 to the housing 16. The housing 16, in this example, is operable as a handheld surface cleaning apparatus, commonly known as a hand vac, when the elongate member 14 is not connected thereto, and in this state the housing 16 can be used with or without the surface cleaning tool 12 connected thereto. The housing 16 supports a suction source 30 and a cyclonic separator device 18. In this example the suction source 30 is an electric motor driving a rotatable fan, but any appropriate suction source may be used. All that is necessary is for the suction source to be able to draw air through the surface cleaning tool 12 and elongate member 14 towards the cyclonic separator device 18.

In this example the housing 16 supports or contains a battery to provide electrical power to the suction source and other components of the apparatus 10. In alternative embodiments, the apparatus 10 may be mains powered.

Whilst in the present embodiment the apparatus 10 includes a cyclonic separator to separate dirt from the air flowing through the apparatus 10, this is not essential. Indeed, embodiments are envisaged where the apparatus 10 includes a filter bag which collects dirt, or any other appropriate device to separate the dirt from the air. The apparatus 10 includes a pivotally moveable door 18*a* which enables a user to empty dirt collected in the cyclonic separator device 18.

The elongate member 14 includes a passage for carrying dirt-laden air from the surface cleaning tool 12 to the cyclonic separator device 18. In this example the surface cleaning tool 12 includes a motor for driving a rotatable floor agitating member or brush, so the elongate member 14 includes a further passage through which electrical cables may extend to provide an electric connection between the housing 16 and the motor in the surface cleaning tool 12.

The surface cleaning tool 12 is disconnectable from the elongate member 14, so that, for example, another tool can be connected to the free end of the elongate member 14. The elongate member 14 is also disconnectable from the housing 16, by way of a manually operated switch 17. This enables the housing 16 to be used as handheld surface cleaning apparatus, with the option of being able to connect another tool to the location from where the elongate member 14 is removed.

The housing 16 includes a handle for holding the apparatus 10, said handle including first 20 and second 21 user-graspable portions which are connected to each other substantially at right-angles. A first end of the first user-graspable portion 20 is connected to the housing 16 and extends generally rearwardly away therefrom and from the elongate member 14. A first end of the second user-graspable portion 21 is connected to the housing 16 and extends generally upwardly therefrom. Respective second ends of the first 20 and second 21 user-graspable portions are connected to each other. Essentially, the first 20 and second 21 user-graspable portions form a handle which is L-shaped and which provides two locations each of which is sized such that it can be grasped fully by a hand of a user. A device 22, e.g. a switch, for turning the apparatus "on" is positioned at the connection of the second ends of the first 20 and second 21 user-graspable portions to each other.

In the present embodiment, the cyclonic separator device 18 is a generally cylindrical body having an elongate axis A. The elongate axis A is substantially horizontal in normal use. The cyclonic separator device 18 has first and second dirt collection chambers 18*b*, 18*e* provided at one end 107*a* thereof.

An upstream wall 112 of the housing 16 extends along the elongate axis H of the housing 16 and has an inner surface which partially defines an airflow passage from the inlet 103' of the suction source 30 to an outlet O of the cyclonic separator device 18 of the suction source 30.

Normal use of the surface cleaning apparatus 10 refers to use thereof when the elongate member 14 is inclined at an acute angle with respect to the surface being cleaned. In other embodiments for which the surface cleaning apparatus 10 is a cylinder cleaner, the housing supporting separator device 18 may be generally upright with respect to the floor surface during normal use, and the elongate axis A may be parallel with or inclined with respect to the floor surface. For embodiments where the apparatus 10 is an upright cleaner, the housing may be inclined with respect to the floor surface and the elongate axis A may be parallel or inclined with the floor surface during normal use.

The cyclonic separator device 18 has first and second separating chambers 18*c*, 18*d* adjacent the first and second dirt collection chambers 18*b*, 18*e*.

The cyclonic separator device 18 includes a shroud 100 which also has an elongate axis coaxial with the axis A, the axis A being that about which dirt-laden air is caused to rotate as it passes through the apparatus 10 and circulates around the shroud 100. Shroud 100 is positioned as part of the cyclonic separator device 18 at an end 107*b* thereof which is opposite to the end 107*a* of the cyclonic separator device 18 at which the first and second dirt collection chambers 18*b*, 18*c* are provided. The shroud 100 has a free distal end. Shroud 100 has a generally cylindrical portion 102 having openings therein for the passage of air positioned generally centrally of the cyclonic separating device 18. The portion 102 has a height D.

The first separating chamber 18*c* is for separating relatively coarse dust or debris from the dirt-laden air. The first separating chamber 18*c* is in communication with the first dirt collection chamber 18*b* so that separated dust or debris falls into the first dirt collection chamber 18*b* therefrom.

The second separating chamber 18*d* is positioned generally within the shroud 100 and is for separating relatively fine dust or debris from the dirt-laden air cleaned by the first separating chamber 18*c*. The second separating chamber 18*d* is in communication with the second dirt collection chamber 18*e* so that separated dust or debris falls into the second dirt collection chamber 18*e* therefrom.

The cyclonic separator device 18 includes an inlet 99*a* through which dirt-laden air is drawn into the first separating chamber 18*c*. The inlet 99*a* is configured to direct the incoming dirt-laden air into a generally cylindrical portion of the first separating chamber 18*c* such that it travels circumferentially around an inner surface 19*a* of the first separating chamber 18*c*. Whilst in this embodiment the elongate axes of the dirt collection chambers 18*c*, 18*e* and the shroud 100 are coaxial or substantially coaxial, they need not be. They could, for example, be parallel and offset from each other or inclined relative to each other. Alternatively, the shroud 100 could be positioned generally centrally of the generally cylindrical portion of one or both of the separating chambers 18*c*, 18*e*.

The cyclonic separator device 18 includes an inlet 99*b* through which cleaned dirt-laden air exiting the first separating chamber 18*c* is drawn into the second separating chamber 18*d*. The second separating chamber 18*d* includes a generally frusto-conical portion 50 with a central axis. The frusto-conical portion 50 has an end part 52 in communication with the second dirt collection chamber 18*e* through which fine dust or debris exits therethrough into the second dirt collection chamber 18*e*.

The inlet 99*b* of the second dirt collection chamber 18*e* is configured to direct the incoming cleaned dirt-laden air such that it travels circumferentially around an inner surface 54 of the generally frusto-conical portion 50. The use of such a frusto-conical portion 50 may permit the second separating chamber 18*d* to separate finer dust or debris from the air than that achievable by the first separating chamber 18*c*.

The second dirt collection chamber 18*e* includes a first portion 56 positioned near the end part 52 of the generally frusto-conical portion 50 and a second portion 58 connected to the first portion 56 which extends to an end wall of the cyclonic separator device 18 therefrom. The first and second portions 56, 58 are generally cylindrical with the first portion 56 having a greater cross-sectional area than the second portion 58, i.e. as considered without the portion 50 being positioned therein. In other words, the cross-sectional areas referred to are those defined by the respective inner surfaces of the first and second portions 56, 58 as viewed in side cross-section. In embodiments, the respective areas of the cross-sections may be the same or different. A third portion 60 which is frusto-conical connects the second portion 58 to the first portion portion 56.

The first portion 56 surrounds the end part 52 of the generally frusto-conical portion 50 to define a space S1 therebetween. The first portion 56 extends upwardly along an elongate axis thereof into a space S2 defined by the inner surface of the generally cylindrical portion 102 of the shroud 100.

The first portion 56 has an end which is in sealed engagement or substantially sealed engagement with the end part 52 of the frusto-conical portion 50.

During use, space S1 may advantageously collect dirt or debris and thus may increase the amount of dirt or debris that may be collected by the second dirt collection chamber 18*e*. For applications in which axis A of the cyclonic separator device 18 is horizontal (i.e. such as when used in apparatus 10) or inclined during use, the presence of space S1 lessens the likelihood of collected dirt or debris returning into the second separating chamber 18*d* and thus reducing the cleaning efficiency. An advantage of embodiments of the invention may be that the capacity of the second dirt collection chamber 18*e* is increased through the provision of the space S1 without having to increase the width of the second portion 58 thereof which would otherwise cause a reduction in the capacity of the first dirt collection chamber 18*b* and/or interfere with the efficiency of the first separating chamber 18*c*. It has been realised that it is possible, for embodiments, to utilise part of the space S2 defined by the inner surface of the shroud 10 which defines openings for the passage of air therethrough with satisfactory cleaning efficiency still being achievable.

The second dirt collection chamber 18*e* includes a baffle 62 positioned generally centrally thereof and which extends upwardly from end 107*a* of the cyclonic separator device 18. The baffle 62 terminates in a conical portion. The conical portion extends into the end part 52 of the frusto-conical portion 50 of the second separating chamber 18*d*.

Additionally, advantageously it has been found that performance may be increased for embodiments in which the first portion 50 of the second dirt collection chamber 18*e* extends a height H into the space S2 which is 10-25 mm, optionally or preferably 15-25 mm, optionally or preferably 19.5-21.5 mm, optionally or preferably the height H is 20 mm. Further improvements are found if the height D of the cylindrical portion 102 of the shroud 100 is 30-45 mm, optionally or preferably 30-40 mm, optionally or preferably 32.5-37.5 mm, or optionally or preferably the height D is 35 mm.

Advantageous synergies have been found between the height H and the height D. For example, in embodiments, improvements are found when the ratio (H:D) lies in the range:

1:1.2≤H:D≤1:4.5

Performance improvements are also found when (H:D) lies in the range:

1:1.5≤H:D≤1:2.7

Performance improvements are also found if the ratio (H:D) lies in the range:

1:1.8≤H:D≤1:2.0.

Performance improvements are also found when the ratio (H:D) is 1:1.9.

In embodiments, the generally frusto-conical portion 50 has a height H2 about its central axis which may optionally or preferably be 75-105 mm, optionally or preferably 85-95 mm, optionally or preferably 87.5-92.5 mm, or optionally or preferably H2 may be 90 mm.

Advantageous synergies have been found between the height H and the height H2. For example, in embodiments, improvements are found when the ratio (H:H2) lies in the range:

1:1.2≤H:H2≤1:7.

Performance improvements are also found when (H:H2) lies in the range:

1:1.3≤H:H2≤1:5.3.

Performance improvements are also found if the ratio (H:H2) lies in the range:

1:1.4≤H:H2≤1:4.7

Performance improvements are also found when the ratio (H:H2) is 1:4.5

The first portion 56 has a diameter D1 across its inner surface and the second portion 58 of the second dirt collecting chamber 18*e* is generally cylindrical and has a diameter D2 across its inner surface.

In embodiments, D1 may optionally or preferably be 50-70 mm, optionally or preferably 55-65 mm, optionally or preferably 57.5-62.5 mm, or optionally or preferably D1 may be 61 mm. In embodiments D2 may optionally or preferably be 45-60 mm, optionally or preferably 50-58 mm, or optionally or preferably 54-58 mm, optionally or preferably 55.5-56.5 mm, optionally or preferably D2 may be 56 mm.

Advantageous synergies have been found between D1 and D2. For example, in embodiments, improvements are found when the ratio (D1:D2) lies in the range:

1.05:1≤D1:D2≤1.60:1.

Performance may also be increased if the ratio (D1:D2) is defined by the range:

1.07:1≤D1:D2≤1.40:1.

Performance may also be increased if the ratio (D1:D2) is defined by the range:

1.07:1≤D1:D2≤1.20:1.

Performance may also be increased if the ratio (D1:D2) is defined by the range:

1.07:1≤D1:D2≤1.15:1.

Performance may also be increased if the ratio (D1:D2) is defined by the range:

1.07:1≤D1:D2≤1.13:1.

Performance may also be increased if the ratio (D1:D2) is 1:09:1.

The first portion 56 of the second dirt collection chamber 18*e* has an outer diameter U and the cylindrical portion 102 of the shroud 100 has an inner diameter V. Advantageous synergies have been found between U and V. For example, in embodiments, improvements are found when the ratio (U:V) lies in the range:

1:1.1≤U:V≤1:1.5.

Performance is also increased if the ratio (U:V) is defined by the range:

1:1.2≤U:V≤1:1.4.

Performance may also be increased if the ratio (U:V) is or is about 1:1.3.

In embodiments, the outer diameter U of the first portion of the second dirt collection chamber is in the range 62-67 mm, optionally or preferably 63-65 mm, or optionally or preferably 63.5-64.5 mm, optionally or preferably the outer diameter U is 64 mm. In embodiments, the inner diameter V of the cylindrical portion of the shroud is in the range 78-88 mm, optionally or preferably 80-86 mm, optionally or preferably 82.5-83.5 mm, optionally or preferably the inner diameter V is 83.0 mm.

The cyclonic separator device 18 includes an outlet through which cleaner air exits the second separating chamber 18*d*.

In more detail, shroud 100 has a generally cylindrical portion 102 having a height D. The generally central portion 102 of the shroud 100 includes a framework to support a mesh or the like (not shown) and has openings therein for the passage of air to the inlet 99*b*. Other configurations of the portion 102 are envisaged, for example removing the mesh covering and instead making the openings 104 smaller and greater in number.

It has been found that performance is improved for embodiments in which the generally cylindrical portion 102 has an outer diameter K in the range of 87-91 mm, optionally or preferably in the range of 89-91 mm, and optionally or preferably the outer diameter K is or is about 90 mm.

Additionally, it has been found that performance is improved in embodiments for which an outer surface of the portion 102 (or it's covering, if there is one) is spaced at J from the inner surface 18*d* of the separating chamber 18*c* in the range of 15-17 mm, preferably in the range of 15-17 mm, optionally or preferably in the range of 15.5-16.5 mm, optionally or preferably in the range of 15.75-16.25 mm, optionally or preferably in the range of 15.9-16.1 mm, and optionally or preferably the distance J is 16 mm or about 16 mm.

As regards the dimensions of the first separating chamber 18*c*, in embodiments, it has been found that performance is improved where an inner diameter P of the generally cylindrical portion of the separating chamber 18*c* is in the range of 121-127 mm, optionally or preferably in the range of 123-125 mm, optionally or preferably in the range of 123.5-124.5 mm, or optionally or preferably the distance P is 124.0 mm or about 124.0 mm.

Advantageous synergies have been found between the diameter P and the outer diameter K of the generally cylindrical portion 102 of the shroud 100. For example, in embodiments, improvements are found when the ratio (K:P) lies in the range:

$1:1.2 \leq K:P \leq 1:1.5$.

Performance improvements are also found when (K:P) lies in the range:

$1:1.3 \leq K:P \leq 1:1.5$.

Performance improvements are also found if the ratio (K:P) lies in the range:

$1:1.35 \leq K:P \leq 1:1.45$.

Performance improvements are also found when the ratio (K:P) is 1:1.38.

The generally cylindrical portion 102 of the shroud 100 terminates at an end 106 which faces an inner surface of end 107*a* of the first dirt collection chamber 18*b*, e.g. which faces the pivotally moveable door 18*a*. It has been found that performance is improved in embodiments for which the end 106 of the generally cylindrical portion of the shroud 100 is spaced a distance N from the inner surface 107 in the range of 55-61 mm, optionally or preferably in the range of 56-60 mm, optionally or preferably in the range of 57-58 mm, optionally or preferably in the range of 57-58 mm, optionally or preferably in the range of 57.5-58.5 mm, and optionally or preferably the distance N is or is about 58.0 mm.

A free end of the shroud 100 includes a peripheral skirt 103, one purpose of which is to prevent dirt separated from the air being retrained into the airflow. The skirt 103 extends towards the end surface 108 and inclines outwardly slightly with respect to the cylindrical portion 102. In embodiments, the outer surface of skirt 103 is flush with the outer surface of cylindrical portion 102.

All of the above dimensions/ranges of dimensions have been found, in isolation, to provide improved separation performance.

A number of synergies have been described with reference to advantageous ratios for certain dimensions of the cyclonic separator. Further advantages are obtained for embodiments having cyclonic separators whose dimensions embody two or more such synergistic ratios, i.e. combining two or more of the various sets of dimensions.

The embodiments described above and shown in the figures include a shroud 103 with dimensions which fulfil all of the above ranges, but it should be appreciated that this is not necessary. Indeed, improved performance can be found by utilising one, some or all of the dimensions ranges listed above.

Although the cyclonic separator device has been described in the context of apparatus 10 when the separator is horizontal in normal use, it has been found to provide improved performance when used in other types of surface cleaner apparatus, e.g. upright cleaners or cylinder cleaners, and other orientations, i.e. vertical or otherwise inclined.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A cyclonic separator device for removing dust or debris from dirt-laden air, the device comprising:

a first separating chamber for separating relatively coarse dust or debris from the dirt-laden air;

an inlet through which dirt-laden air is drawn into the first separating chamber;

a first dirt collection chamber in communication with the first separating chamber;

a shroud;

a second separating chamber positioned generally within the shroud for separating relatively fine dust or debris from the dirt-laden air cleaned by the first separating chamber, a second dirt collection chamber in communication with the second separating chamber;

an outlet through which cleaner air exits the second separating chamber;

wherein the first separating chamber includes a generally cylindrical portion with a central axis and wherein the inlet is configured to direct the incoming dirt-laden air into said generally cylindrical portion such that it travels circumferentially around an inner surface of the first separating chamber, wherein the shroud is positioned generally centrally of the generally cylindrical portion of the first separating chamber and the shroud has a generally cylindrical portion having a height D with openings therein for the passage of air therethrough towards the second separating chamber, wherein the second separating chamber includes:

an inlet through which cleaned dirt-laden air exiting the first separating chamber is drawn into the second separating chamber;

a generally frusto-conical portion with a central axis and the generally frusto-conical portion has an end part in communication with the second dirt collection chamber through which fine dust or debris exits therethrough into the second dirt collection chamber, and wherein the inlet of the second separating chamber is configured to direct the incoming said cleaned dirt-laden air such that it travels circumferentially around an inner surface of the generally frusto-conical portion, wherein the central axis of the first separating chamber extends through the generally frusto-conical portion of the second separating chamber, and wherein a first portion of the second dirt collection chamber surrounds an outer surface of the end part of the generally frusto-conical portion to define a space S1 therebetween and said first portion of the second dirt collection chamber extends into a space S2 defined by the inner surface of the generally cylindrical portion of the shroud having said openings therein.

2. A cyclonic separator device according to claim 1 wherein:

an outer diameter U of the first portion of the second dirt collection chamber and an inner diameter V of the cylindrical portion of the shroud satisfy a ratio (U:V) defined by the range:

1:1.1≤U:V≤1:1.5.

3. A cyclonic separator device according to claim 1 wherein the first portion of the second dirt collection chamber extends a height H into said space S2, and wherein the ratio (H:D) between height H and the height D of the generally cylindrical portion of the shroud is defined by the range:

1:1.2≤H:D≤1:4.5.

4. A cyclonic separator according to claim 3 wherein (H:D) is defined by the range:

1:1.5≤H:D≤1:2.7.

5. A cyclonic separator according to claim 4 wherein (H:D) is defined by the range:

1:1.8≤H:D≤1:2.0.

6. A cyclonic separator according to claim 4 wherein:

the first portion of the second dirt collecting chamber is generally cylindrical and has a diameter D1 across its inner surface; and the second portion of the second dirt collecting chamber is generally cylindrical and has a diameter D2 across its inner surface, wherein the ratio (D1:D2) is defined by the range:

1.05:1≤D1:D2≤1.60:1.

7. A cyclonic separator device according to claim 3 wherein the second dirt collection chamber includes a second portion connected to the first portion, wherein the first portion has a greater cross-sectional area than the second portion.

8. A cyclonic separator device according to claim 7 wherein a third portion which is frusto-conical connects the first portion to the second portion, and wherein the second dirt collection chamber includes a baffle positioned generally centrally thereof and which extends from a lower end of the second portion of the second dirt collection chamber upwardly towards the first portion of the second dirt collection chamber.

9. A cyclonic separator device according to claim 8 wherein the baffle terminates in a conical portion, and wherein the conical portion extends into the end part of the frusto-conical portion of the second separating chamber.

10. A cyclonic separator device for removing dust or debris from dirt-laden air, the device comprising:

a first separating chamber for separating relatively coarse dust or debris from the dirt-laden air;

an inlet through which dirt-laden air is drawn into the first separating chamber;

a first dirt collection chamber in communication with the first separating chamber;

a shroud;

a second separating chamber positioned generally within the shroud for separating relatively fine dust or debris from the dirt-laden air cleaned by the first separating chamber, a second dirt collection chamber in communication with the second separating chamber;

an outlet through which cleaner air exits the second separating chamber;

wherein the first separating chamber includes a generally cylindrical portion with a central axis and wherein the inlet is configured to direct the incoming dirt-laden air into said generally cylindrical portion such that it travels circumferentially around an inner surface of the first separating chamber, wherein the shroud is positioned generally centrally of the generally cylindrical portion of the first separating chamber and the shroud has a generally cylindrical portion with openings therein for the passage of air therethrough towards the second separating chamber, wherein the second dirt separating chamber includes:

an inlet through which cleaned dirt-laden air exiting the first separating chamber is drawn into the second separating chamber;

a generally frusto-conical portion with a central axis and the frusto-conical portion has an end-part in communication with the second dirt collection chamber through which fine dust or debris exits therethrough into the second dirt collection chamber, and wherein the inlet of the second dirt separating chamber is configured to direct the incoming said cleaned dirt-laden air such that it travels circumferentially around an inner surface of the generally frusto-conical portion, wherein the central axis of the first separating chamber extends through the generally frusto-conical portion of the second separating chamber, and wherein the second dirt collection chamber includes:

a first portion which surrounds an outer surface of the end part of the frusto-conical portion to define a space S1 therebetween and said first portion of the second dirt collection chamber extends into a space S2 defined by an inner surface of the generally cylindrical portion of the shroud having said openings therein; and a second portion connected to the first portion, wherein the first portion has a greater cross-sectional area than the second portion.

11. A cyclonic separator device according to claim 10 wherein said first portion of the second dirt collection chamber extends into a space S2 defined by the inner surface of the generally cylindrical portion of the shroud having said openings defined therein.

12. A cyclonic separator device according to claim 10 wherein the first portion of the second dirt collection chamber has an end which is in sealed engagement or substantially sealed engagement with the end part of the frusto-conical portion.

13. A cyclonic separator device according to claim 10 wherein the first portion of the second dirt collection chamber has a height H about its central axis, and the generally frusto-conical portion of the second separating chamber has a height H2 along its central axis, and wherein the ratio (H:H2) between them is defined by the range:

1:1.2≤H:H2≤1:7.

14. A cyclonic separator according to claim 13 wherein the ratio (H:H2) is defined by the range:

1:1.3≤H:H2≤1:5.3.

15. A cyclonic separator according to claim 13 wherein the ratio (H:H2) is defined by the range

1:1.4≤H:H2≤1:4.7.

16. A cyclonic separator according to claim 10 wherein:

the first portion of the second dirt collecting chamber is generally cylindrical and has a diameter D1 across its inner surface; and the second portion of the second dirt collecting chamber is generally cylindrical and has a diameter D2 across its inner surface, wherein the ratio (D1:D2) is defined by the range:

1.05:1≤D1:D2≤1.60:1.

17. A cyclonic separator according to claim 16 wherein the ratio (D1:D2) is defined by the range:

1.07:1≤D1:D2≤1.20:1.

18. A cyclonic separator according to claim 17 wherein the ratio (D1:D2) is defined by the range:

1.07:1≤D1:D2≤1.15:1.

19. A cyclonic separator according to claim 18 wherein the ratio (D1:D2) is defined by the range:

1.07:1≤D1:D2≤1.13:1.

20. A cyclonic separator according to claim 19 wherein the ratio (D1:D2) is defined by the range:

1.07:1≤D1:D2≤1.1:1.

21. A cyclonic separator device according to claim 10 wherein a third portion which is frusto-conical connects the first portion to the second portion, and wherein the second dirt collection chamber includes a baffle positioned generally centrally thereof and which extends from a lower end of the second portion of the second dirt collection chamber upwardly towards the first portion of the second dirt collection chamber.

22. A cyclonic separator according to claim 21 wherein the baffle terminates in a conical portion, and wherein the conical portion extends into the end part of the frusto-conical portion of the second separating chamber.

23. A cyclonic separator device according to claim 10 wherein:

an outer diameter U of the first portion of the second dirt collection chamber and an inner diameter V of the cylindrical portion of the shroud satisfy a ratio (U:V) defined by the range:

1:1.1≤U:V≤1:1.5.

24. A cyclonic separator device according to claim 23 wherein the ratio (U:V) defined by the range:

1:1.2≤U:V≤1:1.4.

* * * * *